US007544871B2

(12) United States Patent
Ringeride

(10) Patent No.: US 7,544,871 B2
(45) Date of Patent: Jun. 9, 2009

(54) SUPPORT SLING FOR STRINGED MUSICAL INSTRUMENTS OF THE VIOLIN FAMILY

(76) Inventor: Karen Ann Ringeride, 11 Stone Tower La., Barrington, RI (US) 02806

( * ) Notice: Subject to any disclaimer, the term of this patent is extended or adjusted under 35 U.S.C. 154(b) by 0 days.

(21) Appl. No.: 12/032,989

(22) Filed: Feb. 18, 2008

(65) Prior Publication Data

US 2009/0007751 A1 Jan. 8, 2009

Related U.S. Application Data

(60) Provisional application No. 60/948,460, filed on Jul. 7, 2007.

(51) Int. Cl.
*G10D 1/02* (2006.01)

(52) U.S. Cl. ..... 84/280

(58) Field of Classification Search ..... 84/327, 84/329

See application file for complete search history.

(56) References Cited

U.S. PATENT DOCUMENTS

| | | | | |
|---|---|---|---|---|
| 7,235,731 | B2 * | 6/2007 | Poff | 84/327 |
| 2005/0183564 | A1 * | 8/2005 | Ripley | 84/327 |
| 2006/0005688 | A1 * | 1/2006 | Miller | 84/327 |

* cited by examiner

*Primary Examiner*—Kimberly R Lockett
(74) *Attorney, Agent, or Firm*—Salter & Michaelson

(57) ABSTRACT

An improved support for stringed musical instruments of the violin family, allowing the musician to play the instrument in a wide range of stable and adjustable playing positions without using pressure from the chin, jaw, neck, left hand, or shoulder resulting in comfortable playing positions and a relaxed body posture, the support sling consisting of one or more narrow lengths of flexible material slipped under the tailpiece of the instrument, over the adjacent shoulder of the musician, down diagonally across the musician's back, under the opposite underarm, and upwardly across the musician's chest until the opposite ends of the sling are adjacent to each other, whereby they may be connected to each other to form a continuous loop that extends around the body of the musician making a close and secure fit.

4 Claims, 3 Drawing Sheets

SUPPORT SLING FOR STRINGED MUSICAL INSTRUMENTS OF THE VIOLIN FAMILY

CROSS-REFERENCE TO RELATED APPLICATIONS

60/948,460 filed Jul. 7, 2007

FEDERALLY SPONSORED RESEARCH

Not applicable

SEQUENCE LISTING OR PROGRAM

Not applicable

BACKGROUND

Field of Invention

This invention relates to supports which are used for playing stringed musical instruments of the violin family to allow the musician to play the instrument without having to engage it between the chin, neck and shoulder.

Supports which are used to hold stringed musical instruments of the violin family (for simplicity hereafter referred to in the text as violin) in playing position are well known and have been described in various forms, most commonly known are the combined use of chin and shoulder rests. The use of these supports for some musicians can cause muscular and dermatological problems which can require long term musical inactivity and medical intervention.

Prior art has shown numerous attempts to correct the problems associated with violin supports by using rigid, semi-rigid, or flexible versions engaging the neck: U.S. Pat. No. 491,372 to Narberti (1893); U.S. Pat. No. 1,337,459 to Lappalainen (1920); U.S. Pat. No. 1,895,749 to Bishop (1933); U.S. Pat. No. 2,576,018 to Johnson (1951); U.S. Pat. No. 3,136,197 to Bried (1964); U.S. Pat. No. 4,765,219 to Alm (1988); U.S. Pat. No. 5,780,756 to Babb (1998); U.S. Pat. No. 4,913,027 to Twohy (1990); U.S. Patent Publication No. 20050183564 to Ripley (2005); U.S. Pat. No. 7,235,731 to Poff (2007); Foreign Pat. No. DE4229934 to Metz (1993). Still other neck engaged versions have a strap around the neck and the device is also supported by the chest: Foreign Pat. No. DE 3210739 to Piechowski (1982) and Foreign Pat. No. DE102005018236 to Bibel (2006). The disadvantages the majority of these versions mentioned above is that they require installation of hardware to the violin and have not eliminated the muscular and dermatological problems that can be associated with use of supports engaging the neck.

Still other versions have a strap which attaches to the violin by means of a hook on one end and to the waistband of the musician's trousers on the other end: (Foreign Pat. No. GB 4475676 to Koerner (1936) and Foreign Pat. No. DE 1295339 to Hueckel (1969)). The disadvantage of these versions is that they require that the musician wear trousers to attach the strap. Still other versions, U.S. Pat. No. 950,873 to Smith (1910) and Foreign Pat. No. DE 29901443U to Dittloff (1999), uses a slot in the middle of the strap which engages the chin rest and the ends of the strap attach to a separate belt worn at the waist of the musician. The disadvantages of this version is that it relies on the use of a chin rest, tension from the strap could disengage the chin rest from the violin possibly resulting in damage to the instrument, and it has not eliminated the muscular and dermatological problems that can be associated with use of supports.

Still another version is included in the design of two experimental violins, where a hardware hook is embedded in the wood on the face of the violin (U.S. Pat. No. 3,822,628 to Quemore (1974)) or on the tail piece end of the violin (U.S. Pat. No. 3,964,362 to Quemore (1976)). The hook on each violin is then attached to a separate strap which would be looped over the left shoulder, around the back, under the right arm and back to the starting point attachment on the violin. The disadvantage of both of these versions requires installing permanent hardware affecting the tonal quality of the violin (Quemore (1974) and Quemore (1976)) as well that would permanently be installed on the face of the violin (Quemore (1974)). Still another (Foreign Pat. No. WO0235192 to Moffitt (Australia) (2002)) used a similar strap placement as described by Quemore (1974 and 1976), but required that the strap be attached to a hardware clip device at or near the chin rest clamp. The disadvantage of this version requires the additional installation of a permanent hardware clip attached to the chin rest hardware attached to the violin which can affect the tonal quality of the instrument as well as possible disengagement of the strap from the strap holder or the chin rest from the violin, possibly resulting in damage to the instrument.

As outlined above, the disadvantages in the above mentioned patents are numerous: all versions have not eliminated the possibility of muscular and dermatological problems for some musicians associated with the use of supports; the majority require installation of at least one element of hardware to the structure of the violin; several may have problems with disengagement of the device from the instrument possibly causing damage; several require the wearing of trousers by the musician. There is a clear need for an improved violin support: one that does not require the installation of hardware to the structure of the violin allowing for improved tonal quality of performance; one that holds the instrument in a wide range of stable and adjustable playing positions safely and securely; one that does not use pressure from the chin, jaw, neck, left hand, or shoulder; and one that results in comfortable playing positions and a relaxed body posture; one that is simple in design and easy to use.

SUMMARY

The invention, an improved violin support, the support sling, stabilizes the violin in any of a wide range of playing positions without using a chin rest, without using support or pressure from the chin, jaw, neck, shoulder, or left hand allowing for improved tonal quality of performance, comfortable playing positions and a relaxed body posture. The support sling is simple in design and easy to use. The embodiment of the present invention consists of one or more narrow lengths of flexible material, natural or synthetic, woven, knit, heat fused, or tubular fabric, plastic or vinyl, cording, of sufficient length to encircle the body of the musician with the violin in playing position, starting from the face of the violin, slipping one end of the said flexible material under the tailpiece of the violin over to one shoulder of the musician, diagonally down across the back of the musician to under the right under arm continuing across the chest overlapping with the other end of said flexible material. The ends are held together by the musician and knotted in a knot, any distance from the ends of said material to form a continuous loop, so as to position the support sling securely and closely and closely to the body of the musician. The ends may also be held together by any number of well known and commonly manufactured adjustable and releasable fasteners, such as an adjustable buckle, adjustable D-rings, adjustable male and female plastic or vinyl luggage type connectors, hook and loop closures, cord locks among others.

Accordingly, the objects and advantages of the invention are combined together in one violin support, the support sling: it does not require pressure from the chin, jaw, neck, left hand, or shoulder; it does not require that the musician rest the violin against the neck to hold the violin in playing position; it does not require that a chin rest be used; it can be used with or without a shoulder rest as preferred by the musician; it does not require rigid hardware installed to the structure of the violin allowing for improved tonal quality of performance; it does not require professional installation; it provides a wide range of adjustable, stable playing positions allowing for comfortable playing and a relaxed body posture; it can be used by left-handed or right-handed players; the support sling holds the violin safely and securely close to musician's body; the support sling is easily stored along with violin in case; and, it can be used by children, adults, professionals, amateurs and students alike. The objects and advantages of the support sling will become clearly apparent from a study of the following description and the accompanying drawings.

DRAWINGS FIGURES

Figure 7:
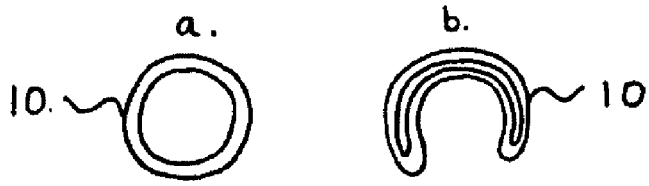

FIG. 7*a*. is a drawing of an additional embodiment of the auxiliary support sling loop; 7*b*. is a drawing of an additional embodiment of the auxiliary support sling loop folded in half.

Figure 8:
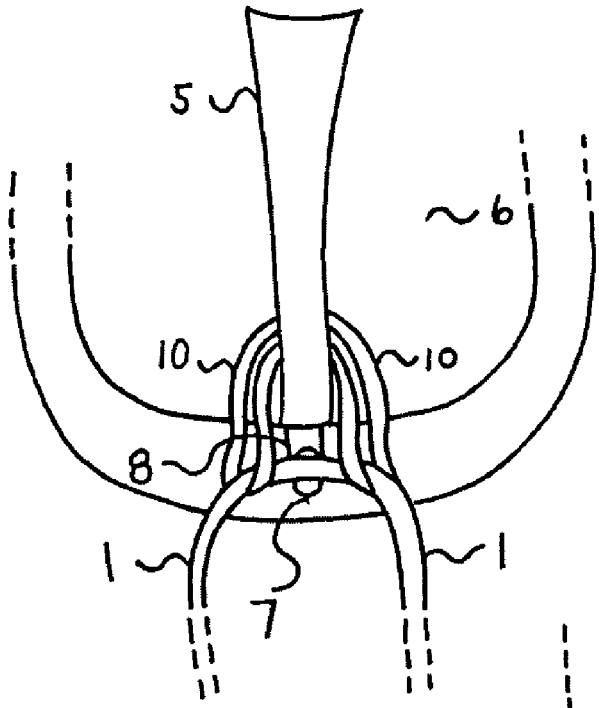

FIG. 8 is a drawing of an additional embodiment of the auxiliary support sling loop folded in half in place under the tailpiece of the violin with the support sling placed through the open loops of the auxiliary support sling loop.

Figure 9:
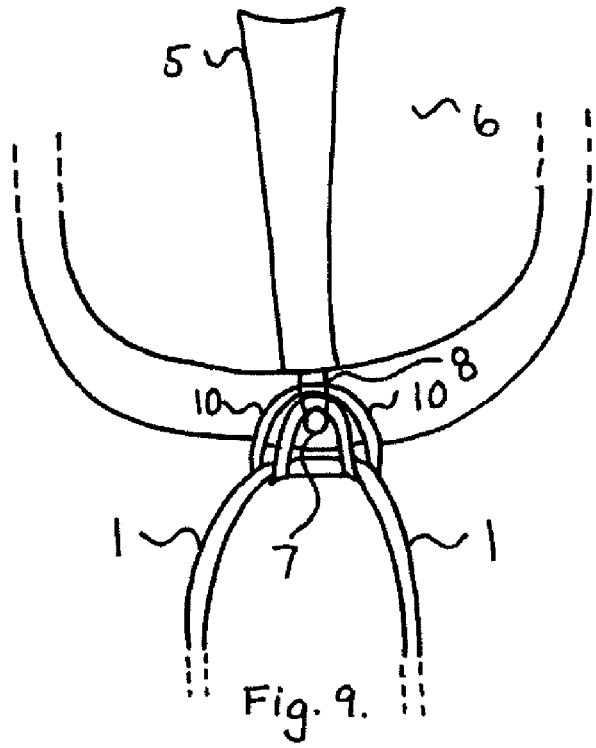

FIG. 9 is a drawing of an additional embodiment of the auxiliary support sling loop folded in half placed between the tailpiece and end pin, under the tailpiece cord of the violin.

DETAILED DESCRIPTION

Figure 1:
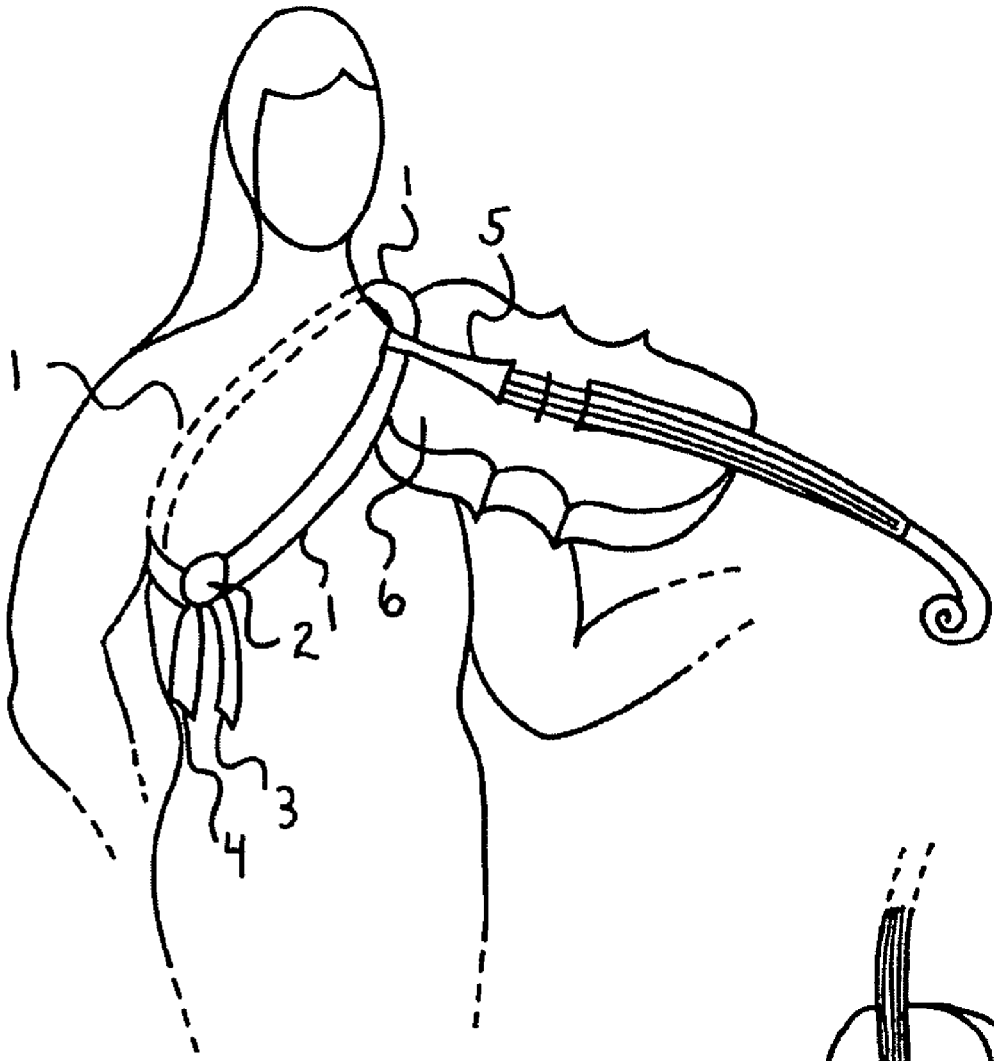
FIG. 1 is a perspective view of the support sling in place under the tailpiece of the violin and secured by a knot to the body of a musician in accordance with the invention.

FIG. 1 is a perspective view of the support sling 1 in place under the tailpiece 5 of the violin and secured by a knot 2 to the body of a musician in accordance with the invention. The placement of the support sling 1 is shown under the tailpiece 5 over the left shoulder of the musician, diagonally across the back, under the right arm and secured by a knot 2 fitting closely to the body of a musician. As shown particularly in FIG. 1, the support sling 1 does not engage the chin or neck of the musician. The chin rest is not used as it is not necessary for support. A shoulder rest is not used as it is not necessary for support but can be used if preferred by the musician.

Figure 2:
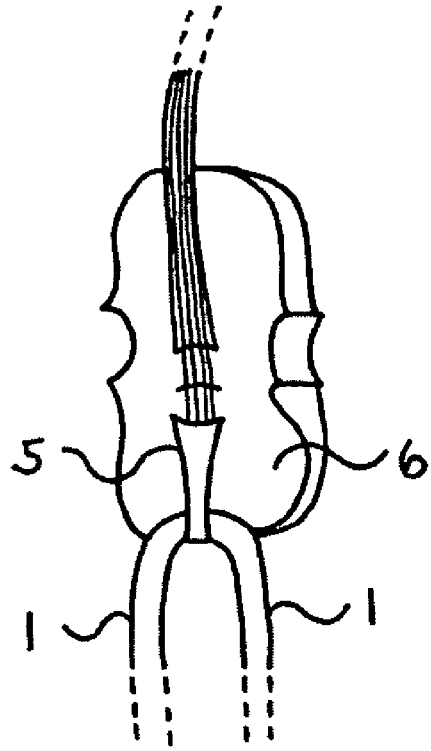
FIG. 2 is a detailed drawing of FIG. 1 showing the support sling in place under the tailpiece on the violin.

FIG. 2 is a detailed drawing of FIG. 1 showing the support sling 1 in place under the tailpiece 5 on the violin.

Figure 3:
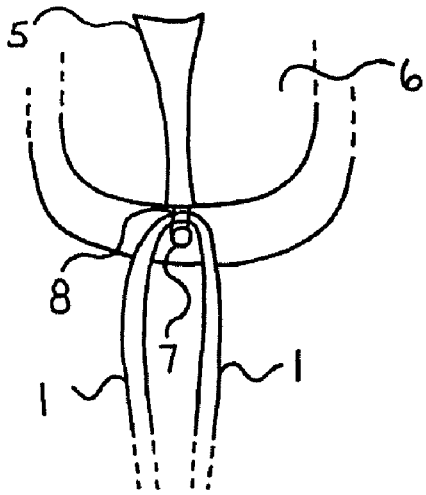
FIG. 3 is an enlarged drawing of the support sling in place on the violin between the tailpiece and the end pin.

FIG. 3 is an enlarged drawing of the support sling 1 in place on the violin between the tailpiece 5 and the end pin 7.

Figure 4:
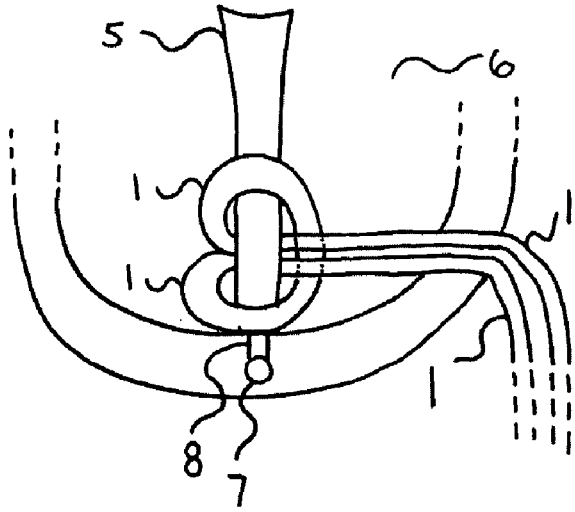
FIG. 4 is a detailed drawing of the alternative placement of the support sling in place on the tailpiece of the violin.

FIG. 4 is a detailed drawing of the alternative placement of the support sling in place on the tailpiece 5 of the violin. The support sling 1 is folded in half, the middle folded portion is placed under the tailpiece 5 and the ends 3 and 4 of the support sling 1 are slipped through the middle hole created by the folding of the support sling 1 and tightened around the tailpiece 5 of the violin.

Figure 5:
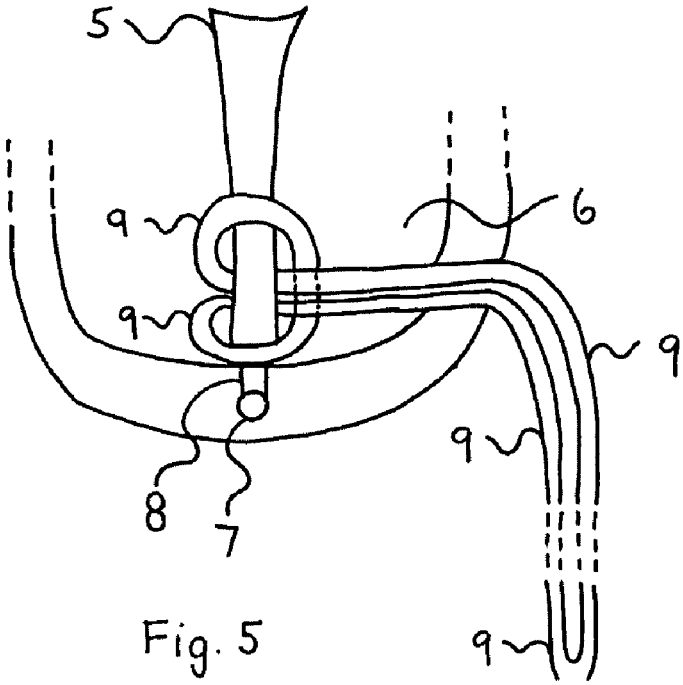
FIG. 5 is a detailed drawing of an additional embodiment the support sling loop in place on the tailpiece of the violin.

FIG. 5 is a detailed drawing of an additional embodiment of a support sling loop 9 in place on the tailpiece 5 of the violin.

Figure 6:
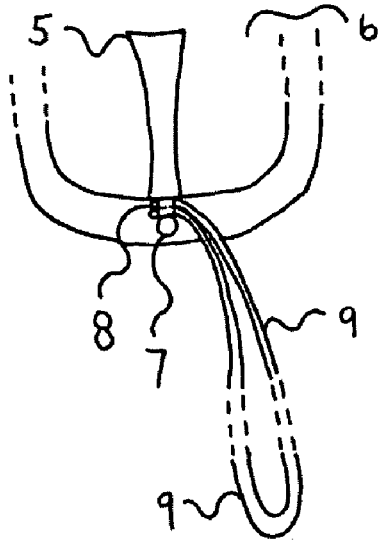
FIG. 6 is a detailed drawing of an additional embodiment of the support sling loop in place between the tailpiece and the end pin, under the tailpiece cord of the violin.

FIG. 6 is a detailed drawing of an additional embodiment of a support sling loop 9 in place between the tailpiece 5 and the end pin 7, under the tailpiece cord 8 of the violin.

FIG. 7*a*. is a drawing of an additional embodiment of an auxiliary support sling loop 10; 7*b*. is a drawing of the auxiliary support sling loop 10 folded in half.

FIG. 8 is a drawing of an additional embodiment of an auxiliary support sling loop 10 folded in half in place under the tailpiece 5 of the violin with the support sling 1 placed through the open loops of the auxiliary support sling loop 10.

FIG. 9 is a drawing of an additional embodiment of an auxiliary support sling loop 10 folded in half placed between the tailpiece 5 and end pin 7, under the tailpiece cord 8 of the violin.

REFERENCE NUMERALS

1 support sling
2 knot
3 one end of support sling
4 other end of support sling
5 tailpiece
6 lower bout area
7 end pin
8 tailpiece cord
9 support sling loop
10 auxiliary support sling loop Operation:

For use, the support sling needs to be adjusted and fit to the musician. The support sling 1 can be adjusted to fit by the musician or by another person assisting the musician. Adjustment and fitting can be done in a standing or sitting position. As the support sling can be used by right-handed or left-handed musicians, the terms right and left can be interchanged in the description below to describe the operation for a left-handed musician.

To adjust and fit by the musician: place the violin on a flat surface with the bridge and strings facing upward. Slip one end of the support sling 1 under the tailpiece 5 on the face of the violin 6 near the endpin 7. Bring the ends of the support sling ends 3, 4 together allowing the approximate midpoint of the support sling 1 to be under the tailpiece 5. The support sling ends 3, 4 can then be knotted together, with a overhand knot 2, square knot, or other various widely known secure knots of the player's choosing, leaving the ends 3, 4 dangling. The player then holds the violin body or neck in the left hand and holds the support sling 1 with the right hand slipping the support sling over the head. The right hand and arm is then slipped through the loop, formed by the knotting of the support sling ends 3, 4, from below allowing the support sling 1 to be positioned under the right underarm. The support sling 1 should be fit close to the body. The musician may then position the violin in any number of playing positions, with or without the shoulder rest, re-adjusting the support sling 1 as preferred. The support sling 1 can be readjusted by holding the violin with one hand/arm, undoing the knot 2 and re-adjusting the length of the support sling 1 and re-knotting tighter or looser against the body of the player depending on the musician's preference. The support sling 1 can also be knotted, adjusted and re-adjusted by a person assisting the player.

It is unnecessary to remove the support sling 1 from the violin after each period of play. To disengage the violin from the musician, the musician can hold the violin with one hand/arm and undo the knot 2 allowing the support sling 1 to remain on the violin. The musician can then place the violin on a flat surface and re-tie the knot 2. Alternatively, as the support sling 1 can be made of a flexible fabric, the musician need only to hold the violin with one hand and pull the violin with support sling 1 in place over the head of the musician at the end of the playing period. The support sling 1 will remain connected to the violin. To resume play, the musician can just slip the support sling 1 over the head, reach the right arm through the loop of the support sling 1, so that the loop is once again position at the right underarm, and move the violin into the desired playing position.

As it is unnecessary to remove the support sling 1 because of its low profile, the violin may then be stored in its case with the support sling 1 in place. For prolonged storage without periods of play, it is recommended that the support sling 1 be removed from the violin by untying the knot 2 and slipping the support sling 1 from underneath the tailpiece 5.

Alternatively, the support sling 1 in additional embodiments can be designed as a continuous support sling loop 9 instead of knotting. Another additional embodiment can use an auxiliary support sling loop 10 attached to a support sling 1.

Alternatively, the support sling 1 in additional embodiments can also have other types of methods of closure for attaching the ends together by using common, well known adjustable and releasable devices, commonly manufactured such as an adjustable buckle, adjustable D-rings, adjustable male and female plastic or vinyl luggage type connectors, among others. The closures can have other shapes such as circular, oval, free-form, trapezoidal, triangular among others.

Although the description above contains many specificities these should not be construed as limiting the scope of the embodiment. Other embodiments and variations to the present embodiments will be apparent to those skilled in the art and may be made without departing from the scope of the invention as defined in the following appended claims and their legal equivalents.

I claim:

1. An improved support for a stringed musical instrument of the violin family, said support comprising a sling made from a narrow length of flexible material, said sling having first and second ends, said first end extending upwardly across the chest area of a musician holding the instrument, underneath the tailpiece assembly of the instrument, over the musician's adjacent shoulder and then diagonally downwardly across the musician's back, underneath the musician's opposite underarm to a point where said first and second end portions are adjacent each other, and means releasably connecting said end portions to each other, whereby said sling forms a continuous loop extending diagonally upward across the musician's chest, underneath the instrument tailpiece, over the musician's adjacent shoulder, diagonally downward across the musician's back, and then underneath the musician's opposite underarm.

2. An improved support according to claim 1, wherein said connecting means comprise a knotting engagement of said first and second ends.

3. An improved support according to claim 1, wherein said connecting means comprise a mechanical fastener device.

4. An improved support for a stringed musical instrument of the violin family, said support comprising a sling made from a narrow length of flexible material, said sling comprising an elongate endless loop, one portion of which passes beneath the instrument tail piece assembly, said portion looping around said tailpiece assembly with the remainder of the endless loop passing through the loop so formed to effect a slip-knot connection between the endless loop and the instrument, the remainder of the endless loop functioning as a sling having a portion extending upwardly across the chest area of the musician holding the instrument, over the musician's adjacent shoulder, diagonally downward across the musician's back, and then underneath the musician's opposite underarm.

* * * * *